US006325038B1

(12) United States Patent
Millett

(10) Patent No.: US 6,325,038 B1
(45) Date of Patent: Dec. 4, 2001

(54) SPHERICAL INTERNAL COMBUSTION ENGINE

(75) Inventor: James A. Millett, Ramona, CA (US)

(73) Assignee: Spherical Propulsion, LLC, Rancho Santa Margarita, CA (US)

( * ) Notice: Subject to any disclaimer, the term of this patent is extended or adjusted under 35 U.S.C. 154(b) by 0 days.

(21) Appl. No.: 09/484,295

(22) Filed: Jan. 18, 2000

(51) Int. Cl.[7] ..... F02B 53/00
(52) U.S. Cl. ..... 123/241; 418/68
(58) Field of Search ..... 123/141; 418/68

(56) References Cited

U.S. PATENT DOCUMENTS 3,809,025 * 5/1974 Harper ..... 418/68 X
3,934,559 * 1/1976 Cohen ..... 123/141
5,993,182 * 11/1999 Beldy et al. ..... 418/68
6,135,743 * 10/2000 Keikov et al. ..... 418/68 X

* cited by examiner

*Primary Examiner*—Hoang Nguyen
(74) *Attorney, Agent, or Firm*—G. Donald Weber, Jr.

(57) ABSTRACT

A rotary displacement device which can be a spherical internal combustion engine, comprising a housing having a generally spherical cavity therein; a displacement member with generally spherical inner and outer configurations mounted within the cavity in the housing; and a drive mechanism including a drive shaft with a nutating member mounted thereto at a spherically shaped mounting portion positioned within the inner spherical configuration of the displacement member. The drive mechanism, displacemnent member and spherical cavity all share a common, fixed, center point. The displacement member travles in an arc within the cavity such that the axis of the arc passes through the center point. The displacement member drives the nutating member through a defined movement path which path passes through the center point. The nutating member drives the drive shaft in a rotational path the axis of which passes through the common center point. This operation distinguishes this rotary displacement device from all other known nutating and/or spherical engines.

20 Claims, 7 Drawing Sheets

SPHERICAL INTERNAL COMBUSTION ENGINE

BACKGROUND

1. Field of the Invention

This invention is directed to internal combustion engines, in general, and to spherical internal combustion engines, in particular.

2. Prior Art

Internal combustion engines are well known. These engines have various sizes and shapes, as well as a variety of numbers of displacement members and/or operating cycles.

One such engine is described in U.S. Pat. No. 5,404,849 by Fenton. However, this engine, together with the engines cited therein, has various drawbacks, including but not limited to, the size/weight ratio as well as the cost to manufacture the engine.

Another spherical engine is described in U.S. Pat. No. 5,336,067 by Lim. This engine uses a nutating member and is purported to increase the seal between the rotor and the engine head.

Other such engines are known in the art. However, none of the known engines have the advantages of the engine shown and described herein.

SUMMARY OF THE INSTANT INVENTION

A rotary displacement device, typically an internal combustion engine, comprises a housing of virtually any exterior configuration but which includes a generally spherical cavity therein. A displacement member (akin to a piston in a conventional engine) with a generally spherical configuration is mounted within the cavity in the housing. The displacement member also includes a generally spherical opening therein. A drive mechanism comprising a drive shaft with a nutating member mounted thereto includes a spherically shaped mounting portion positioned intermediate the ends of the drive shaft. The mounting portion is disposed within the inner spherical opening of the displacement member. The displacement member travels in an arc within the cavity in the housing as the result of internal combustion operations. The axis of the arc passes through the center point of the engine. The displacement member drives the nutating member through a defined movement path, the axis of which also passes through the center point. The nutating member, in turn, drives the drive shaft in a rotational path the axis of which passes through the center point. Thus, the drive mechanism, displacement member and spherical cavity share a common, fixed center point which operation distinguishes this engine from all other known nutating and/or spherical internal combustion engines. Of particular interest to this invention is a spherical engine which produces a significant amount of displacement relative to the weight and size thereof and does not apply any bearing forces to the surfaces that form the displacement chambers. Such an engine has many uses.

DESCRIPTION OF A PREFERRED EMBODIMENT

Figure 1:
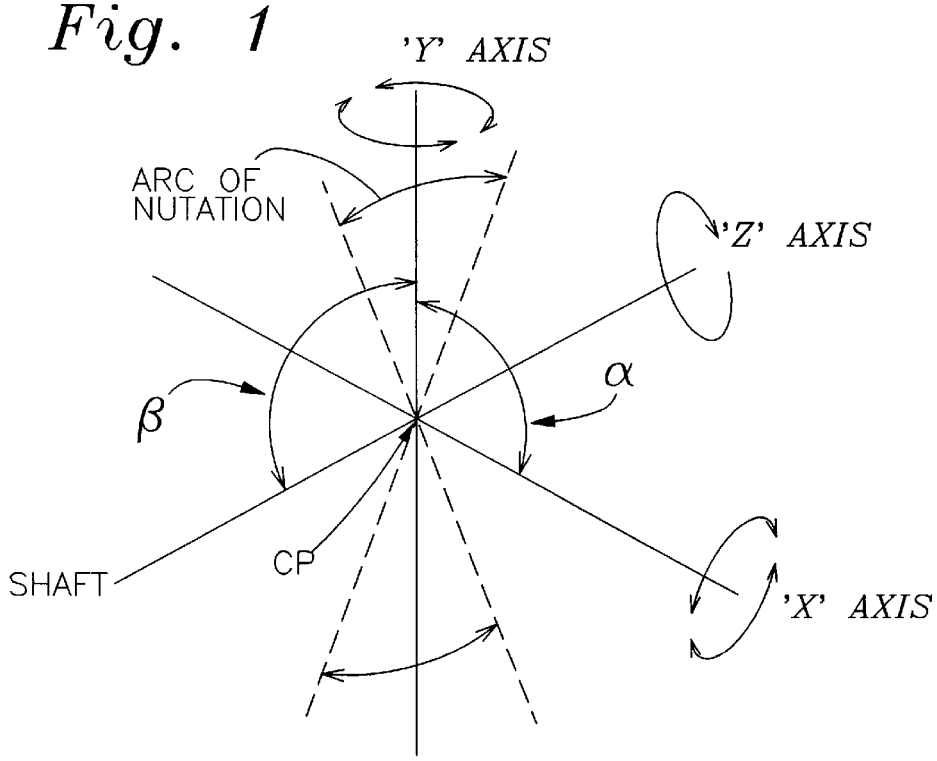
FIG. 1 is a diagram of the axial relationships of the significant components of the instant invention.

Referring now to FIG. 1, there is shown a diagram of the basic axial relationship of the significant components of the rotary displacement device of the instant invention. The device is, typically, but not limited to an internal combustion engine. The representative diagram is, essentially, arranged along the X, Y and Z-axes which intersect in a virtual, common point CP determined by the axes. It should be understood that the components represented by these axes are mounted within an external housing which is not shown.

Typically, the Z-axis represents the axis of the drive shaft which delivers the operating utility of the device to a utility apparatus, such as a propeller or the like, not shown. The drive shaft rotates clockwise (or counterclockwise) around the Z-axis.

Similarly, the X-axis represents the axis of the displacement member of the displacement device. In the basic displacement operation, the displacement member rotates in arcs in the clockwise and counterclockwise directions around the X-axis. Typically, the X and Z-axes are disposed at 90° to each other.

In this embodiment, the Y-axis represents the axis of the nutating member which is mounted on the drive shaft to form the drive shaft/nutating member assembly. The nutating member is engaged by the displacement member and moves therewith thus describing an arcuate(the arc of nutation) of the engagement point which parallels the Z-axis of the drive shaft. The nutating member drives the drive shaft which rotates in the clockwise (or counterclockwise) direction around the Z-axis. The angle $\beta$ between the Y-axis and the Z-axis varies in relation to drive shaft rotation. The angle $\alpha$ between the X- and Y-axes is fixed by the housing and displacement members (not shown).

Figure 2:
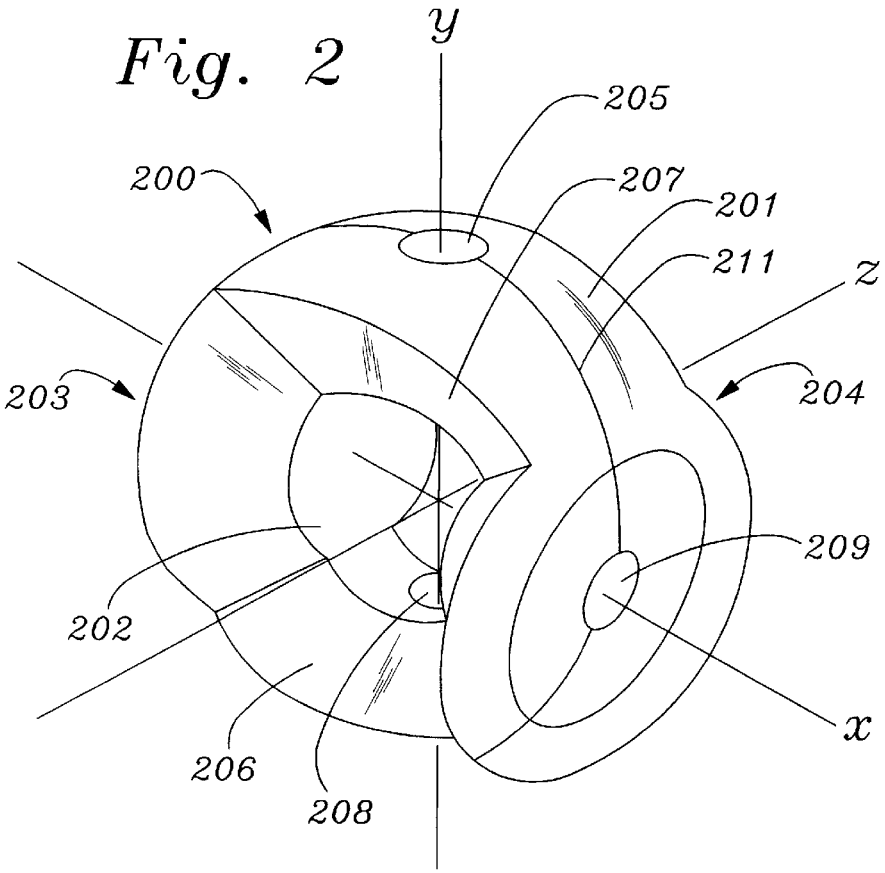
FIG. 2 is an oblique view of the displacement member of the engine of the instant invention.

Referring now to FIG. 2, there is shown an oblique view of the displacement member 200 of the instant invention. The displacement member, as will be described infra, is akin to a piston in a conventional internal combustion engine.

The assembled displacement member 200 is generally, a hollow sphere in configuration with an outer surface 201 and an inner surface 202. Relatively large drive shaft apertures 203 and 204 are provided in opposite faces of the displacement member sphere. The shaft aperture 203 defines the force faces 205 and 206 for the displacement member 200 and are akin to piston head surfaces in conventional internal combustion engines. The shaft aperture 204 defines similar force faces not visible in FIG. 2.

Figure 3:
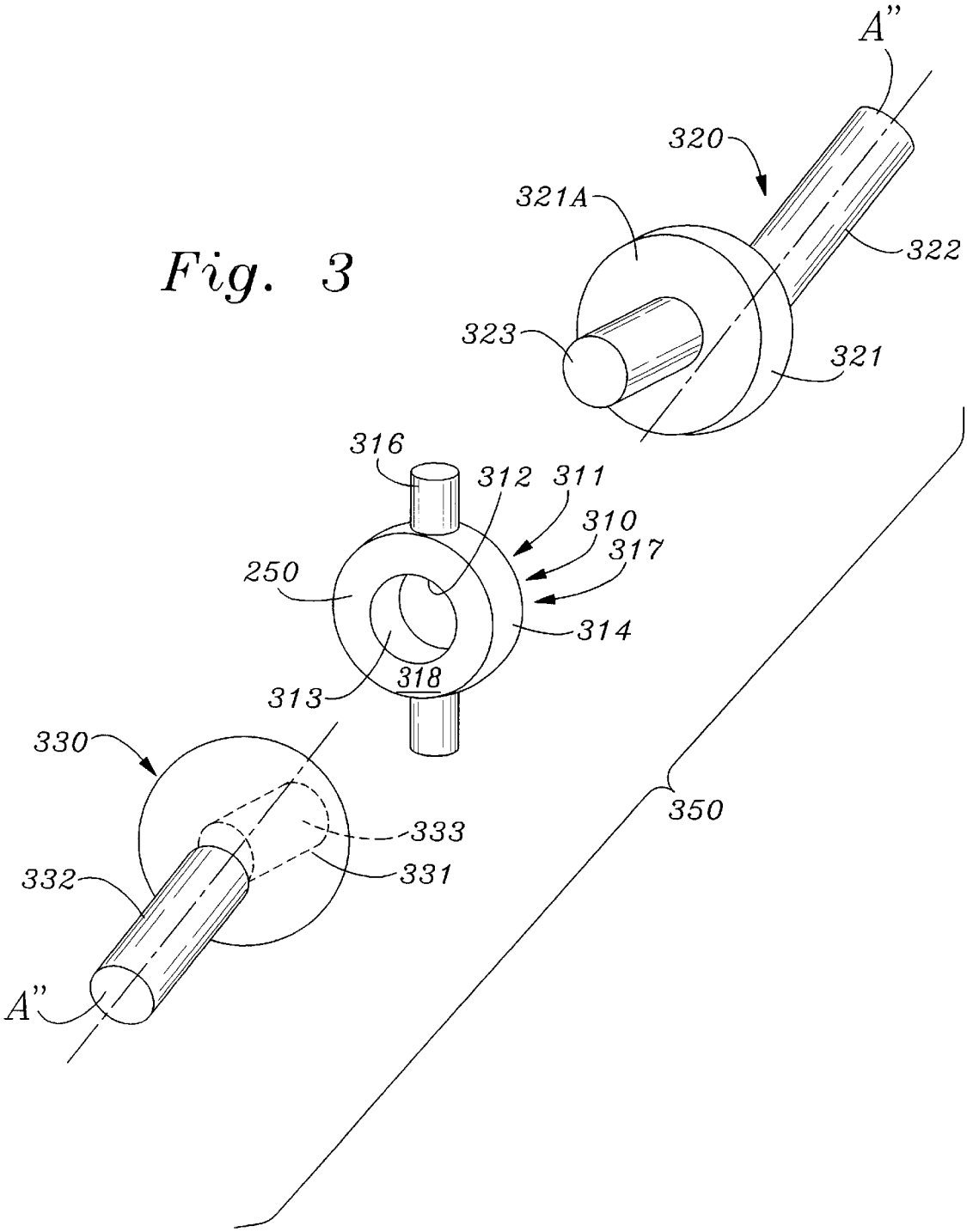
FIG. 3 is an exploded view of the drive shaft/nutating member assembly of the engine of the instant invention.

The displacement member 200 includes diametrically opposed apertures 207 and 208 for receiving the pintles 315 and 316 which extend outwardly from the nutating member assembly 350 (see FIG. 3). In this embodiment, the apertures 207 and 208 are depicted as extending completely through the wall of the displacement member on the Y-axis (shown in FIG. 1) but may extend only part way through the displacement member as suggested in FIG. 4.

Figure 4:
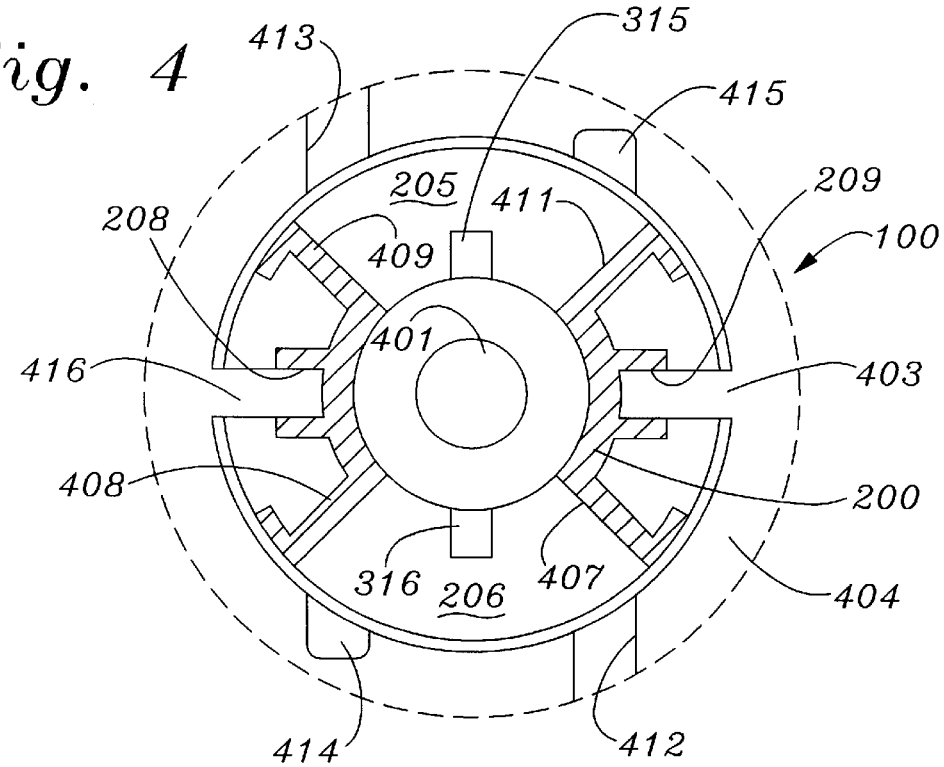
FIG. 4 is a front, cross-sectional view of one embodiment of an internal combustion engine of the instant invention.
Figure 5:
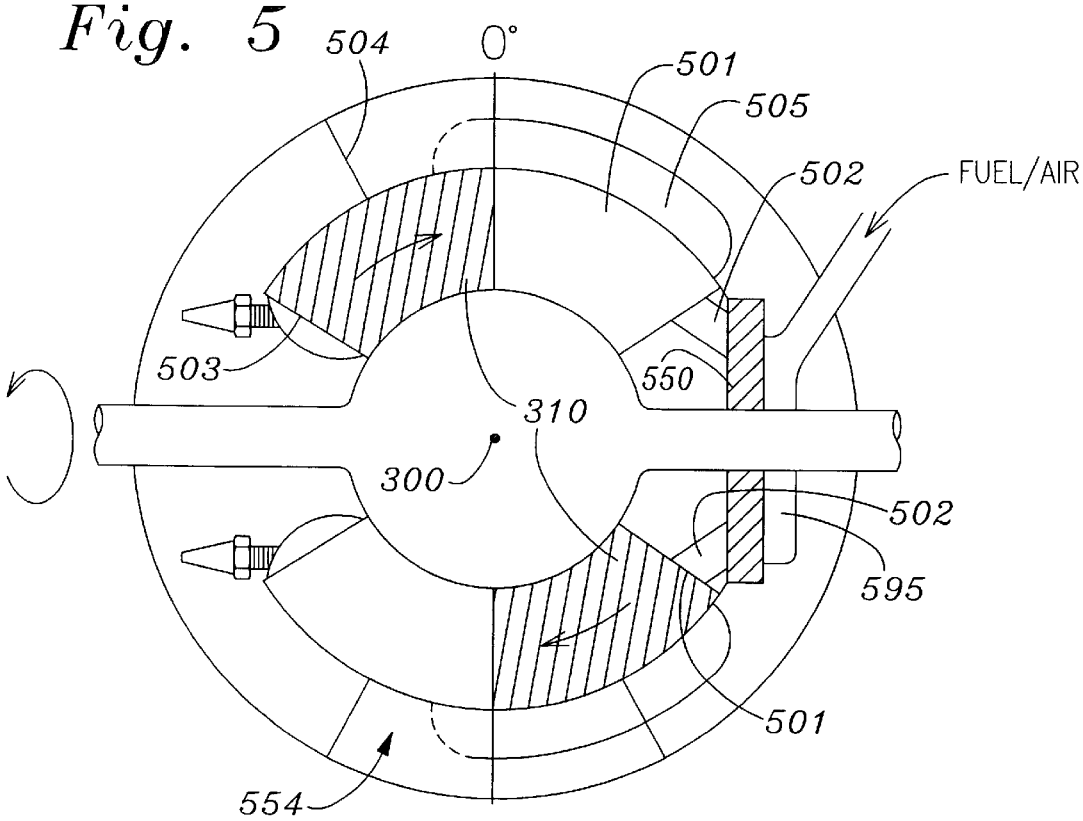
FIGS. 5 through 10 are side, cross-sectional views of the internal combustion engine of the instant invention in different phases of operation.

In addition, the displacement member 200 includes diametrically opposed bearing apertures 209 and 210 (only aperture 209 is visible in FIG. 2) for receiving the bearing rods 403 and 416 which project from the inner surface of the engine housing 404 as shown in FIG. 4. Typically, the bearing apertures 209 and 210 extend only part way through the wall of the displacement member 200 on the X-axis as shown in FIG. 4.

As will be described infra, the drive shaft 401 extends through the drive shaft apertures 203 and 204 to define the Z-axis of the device. The assembled drive shaft/nutating assembly 350 (shown infra) is mounted within the hollow displacement member 200 by securing the halves of the displacement member at the joint line 211. The halves of the displacement member 200 are joined together in conventional fashion such as bolting or other fastening means.

Thus, with this arrangement, the drive shaft/nutating member assembly 350 is linked to the displacement member 200 by the pintles 315 and 316 which extend into apertures 207 and 208 and define the Y-axis for the displacement device/engine. The displacement member 200 is mounted within the engine housing 404 (see FIG. 4) by the bearings 403 and 416 (which define the X-axis of the engine) and which are inserted in to the bearing apertures 209 and 210. As will be seen, the drive shaft is also secured in the engine housing to define the Z-axis of the engine. This arrangement clearly defines a substantially fixed, center point formed by the intersection of the X, Y and Z-axes of the engine.

Thus, it will be seen that the displacement member 200 in FIG. 2 is supported in three planes (as defined by the three axes) whereupon, the displacement member 200 cannot move in any axial direction. As a consequence, the displacement member 200 can be precisely mounted within the engine housing (see infra) whereupon lubrication problems can be substantially eliminated.

Referring now to FIG. 3, there is shown an exploded view of a representation of the drive shaft/nutating member assembly 350 (also referred to as the assembly 350) of the instant invention. In this embodiment, the assembly 350 comprises a central unit or nutating member 310 which includes a generally annular body 311 having two substantially parallel, smooth surfaces 317 and 318 with a central bore 312 therethrough. The inner surface 313 of the bore 312 is smooth and generally perpendicular to the bearing surfaces 317 and 318 of the annular body 311. The outer surface 314 of the annular body is smooth but slightly curved to form a portion of the spherical surface of the nutating assembly 350.

Extending radially outward from the outer surface of the annular body 311 are pintles 315 and 316 each of which is generally cylindrical in configuration. The pintles act as the bearings for the annular body 311.

The one end portion 320 of the assembly 350 includes a body portion 321 the outer surface of which is, essentially, hemispherical in configuration. The spherical surface of body portion 321 is conformed to provide a continuous spherical surface with the outer surface 314 of the annular body 311.

A shaft 322 extends axially outward from the spherical body portion 321 of the end portion 320 and forms one end of the drive shaft 401 of the assembly 350 as described infra.

Body portion 321 also includes a bearing surface 321A. The surface 321A of the body portion 321 is configured to smoothly abut the bearing surface 317 of the annular body 311 of the central unit 310 of the assembly 350.

The bearing surface 321A is disposed at an angle to the axis of the drive shaft 322. The angle of the bearing surface 321A and the bearing shaft 323 are determined by (and determinative of) the nutating angle p shown in FIG. 1.

A bearing shaft 323 extends axially outwardly from the bearing surface 321A of the end portion 320 at an angle relative to the Z-axis of the shaft. The bearing shaft 323 has a diameter which fits snugly, but smoothly and rotatably, through the central bore 312 of the annular body 311. The outer surface of shaft 323 and the inner surface of bore 312 provide a bearing interface for these components.

The second end portion 330 of the drive shaft assembly 350 includes a body portion 331 which is, essentially, hemispherical in configuration with a flat bearing surface (not visible in this Figure). The bearing surface of portion 331 is configured to snugly abut bearing surface 318 of the annular body 311 of the ) central unit 310 of the driver assembly 350. Thus, hemispherical surface of body portion 331 complements the outer surface 314 of annular body 310 and the hemispherical surface of body portion 321 of the end portion 320 to define a smooth spherical body as will be shown and described infra.

A shaft 332 extends axially outwardly from the spherical body portion 331 of end portion 330 and forms the other end of the drive shaft of the assembly 350.

The end portion 330 includes a bore 333 or cavity (shown in dashed line) formed in the bearing surface thereof. The cavity 333 is configured to snugly receive and, effectively, capture the shaft 323 which extends at an angle from the bearing surface 321A of the first end portion 320. Thus, the first and second end portions 320 and 330 are securely engaged and form an integral drive shaft/nutating assembly 350 which moves as one, and which supports the annular body 311 which rotates freely around the bearing shaft 323.

It is noted that the angles defined by the bearing surfaces of end portions 320 and 330 are the same wherein the bearing surfaces thereof are substantially parallel. While not shown in detail, it should be understood that all of the bearing surfaces of body portions 321 and 331 as well as the outer surface of bearing shaft 323 may be devised to include suitable bearings such as, but not limited to, ball bearings with appropriate races and the like. Thus, the nutating member 310 is free to move relative to the overall assembly 350.

Figure 3A:
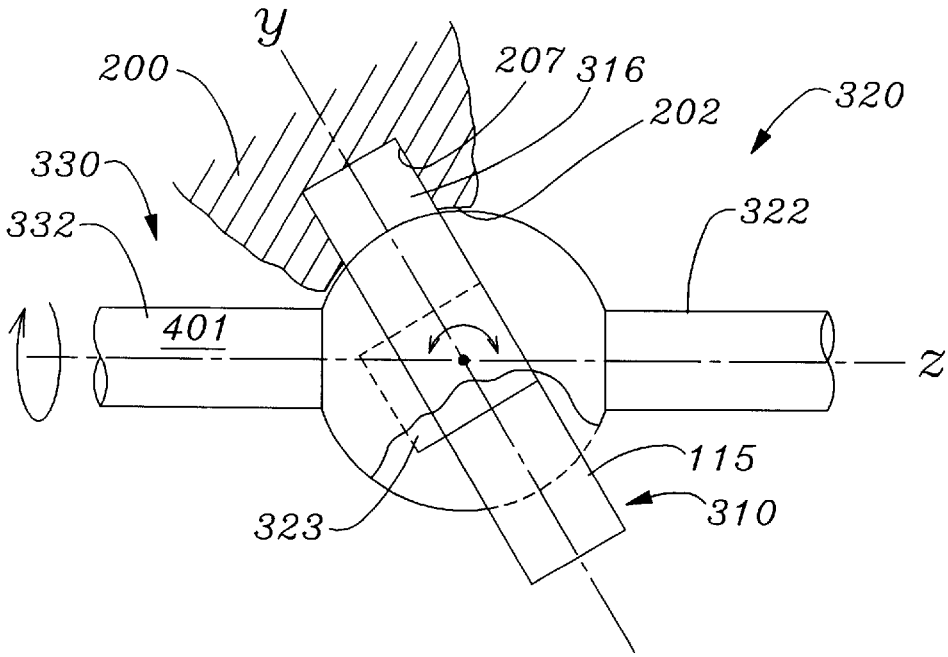
FIGS. 3A, 3B and 3C are partially broken away views of the drive shaft/nutating member assembly shown in FIG. 3.
Figure 3B:
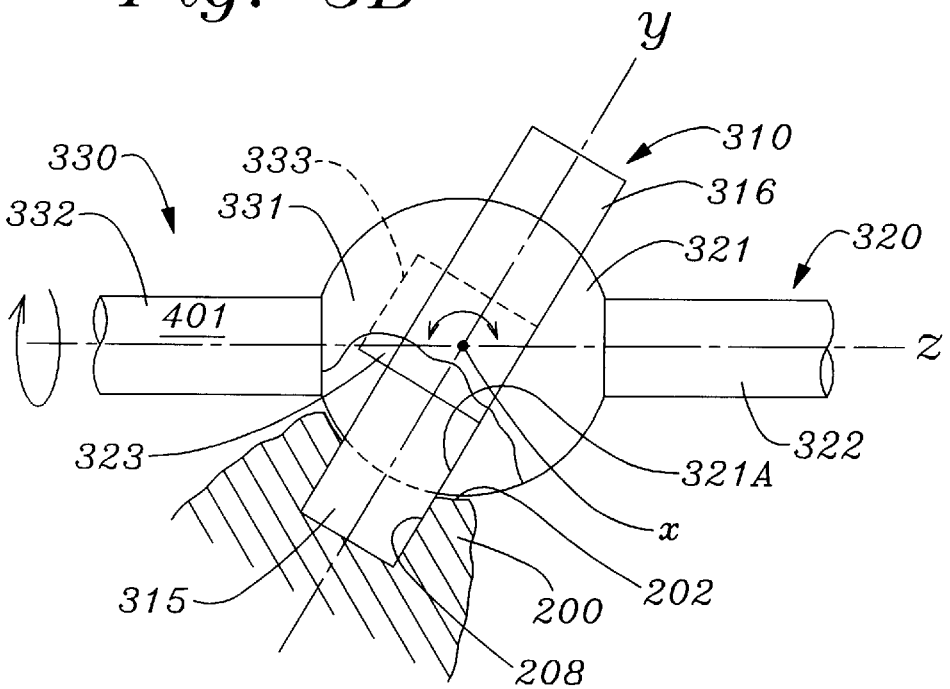
Figure 3C:
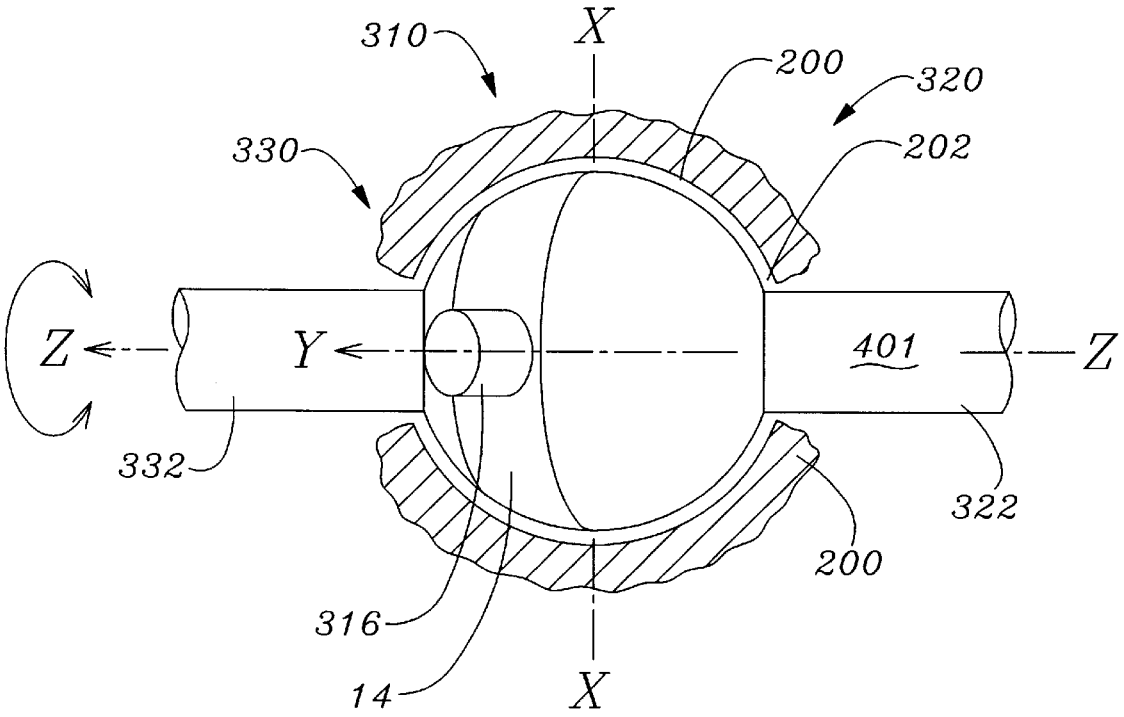

Referring concurrently now to FIGS. 3A, 3B and 3C, there are shown several partially broken away views of the assembled drive shaft/nutating member 350. In particular, FIG. 3B shows the mechanism of FIG. 3A rotated 180° while FIG. 3C is a top view of the mechanism shown in FIG. 3A.

In each of these views, the X, Y and Z-axes are depicted. Moreover, the Z-axis drive shaft 401 (comprising shafts 322 and 332) is shown to rotate in either the clockwise or counter clockwise direction; the Y-axis moves in a straight line which is parallel to the Z-axis, and the X-axis rotates through both clockwise and counter clockwise arcs of about 60° in this embodiment.

In each of FIGS. 3A, 3B and 3C, a portion of the displacement member 200 is shown for reference purposes. That is, the displacement member 200 substantially surrounds the spherical portion of drive shaft assembly 350 and engages the pintles 315 and 316. Inasmuch as the axis center point CP of the drive shaft assembly 350 and the displacement member 200 remains fixed, the spacing between the drive shaft assembly and the interior surface 202 of the displacement member 200 can be minimized. Moreover, because these components are, effectively, maintained with a fixed center point, minimal lubrication is needed therebetween.

Referring now to FIG. 4, there is shown a front, cross-sectional view of one embodiment of an engine 100 utilizing the principles of the instant invention. In particular, the view of the engine 100 as shown in FIG. 4 is taken perpendicular to the drive shaft 401 (see shafts 322 and 332 in FIG. 3) and depicts the displacement member force faces 205 and 206 as a portion of the generally spherical displacement member 200. The displacement member 200 is mounted for axial rotation around the bearing shafts 403 and 416 (equivalent to the X-axis in FIG. 1) which are rotatably mounted in the outer engine housing 404 (which is schematically represented by the dashed outline inasmuch as the housing 404 may be any configuration as desired). The displacement member 200 is also mounted to the pintles 315 and 316 of nutating member 310 which is arranged at approximately 90° to each of the shaft 401 and axial bearings 403 and 416.

With the configuration shown in FIG. 4, the engine is adapted for a two-cycle operation. That is, the displacement member rotates about bearings 403 and 416 with displacement member faces 205 and 206 being alternately driven by the internal combustion within the chamber at least partially defined by the displacement member 200 as shown and described infra. The combustion chambers are further defined by the walls 407, 408. 409 and 411.

As seen in FIG. 4, exhaust ports 412 and 413 pass through the engine housing 404 and can be connected to any suitable exhaust manifold or the like.

Likewise, bypass ports 414 and 415 are formed as channels or the like on the inner surface of housing 404. The bypass ports communicate with the intake and intake chambers on the opposite sides of the displacement member as shown and described infra.

Referring concurrently to FIGS. 5 through 10, there is shown a series of cross-sectional views of the engine 100 shown in FIG. 4 with the displacement member 200 in various angular positions during the operation thereof. In the position shown in FIG. 5, displacement member 200 is in the 0° position, as defined herein. In this position, the intake chamber 501 is being (or has been) filled with the air/fuel mixture which is supplied via a conventional carburetor (not shown), through the intake manifold 575, the rotary valve 550 and an input port 502. The air/fuel mixture is prevented from entering or exiting intake chamber 551 by the rotary valve 550 which is closed relative to input port 502. (In any event, the displacement member 200 is in the intake chamber 551 in this position.

Figure 6:
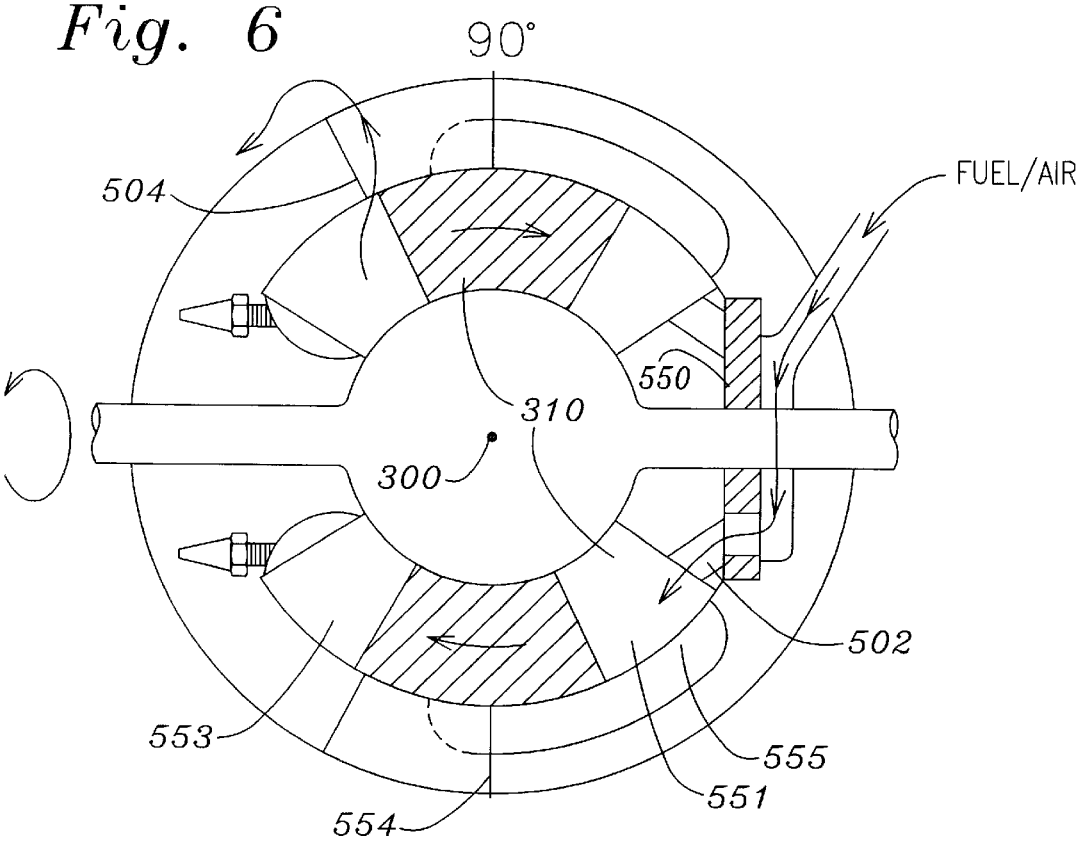

As the displacement member 200 rotates (in the clockwise direction in FIG. 5) around the rotation axis 300 (i.e. the X-axis in FIG. 1) toward the 90° position shown in FIG. 6, the air/fuel mixture will be compressed in intake chamber 501. Also, the rotary valve 550 is closed and the air/fuel mixture is ready to be compressed. As the displacement member 200 continues to rotate in the clockwise direction to the 90° position, the exhaust port 504 in combustion chamber 503 has been uncovered (opened), as seen in FIG. 6, so that any remnants of a prior operating cycle can be exhausted through a suitable exhaust manifold or the like (not shown).

Concurrently, the displacement member 200 is also rotating so as to close exhaust port 554 and to compress any air/fuel mixture which may have previously been introduced into the combustion chamber 553 from intake chamber 551 via bypass port 555.

Figure 7:
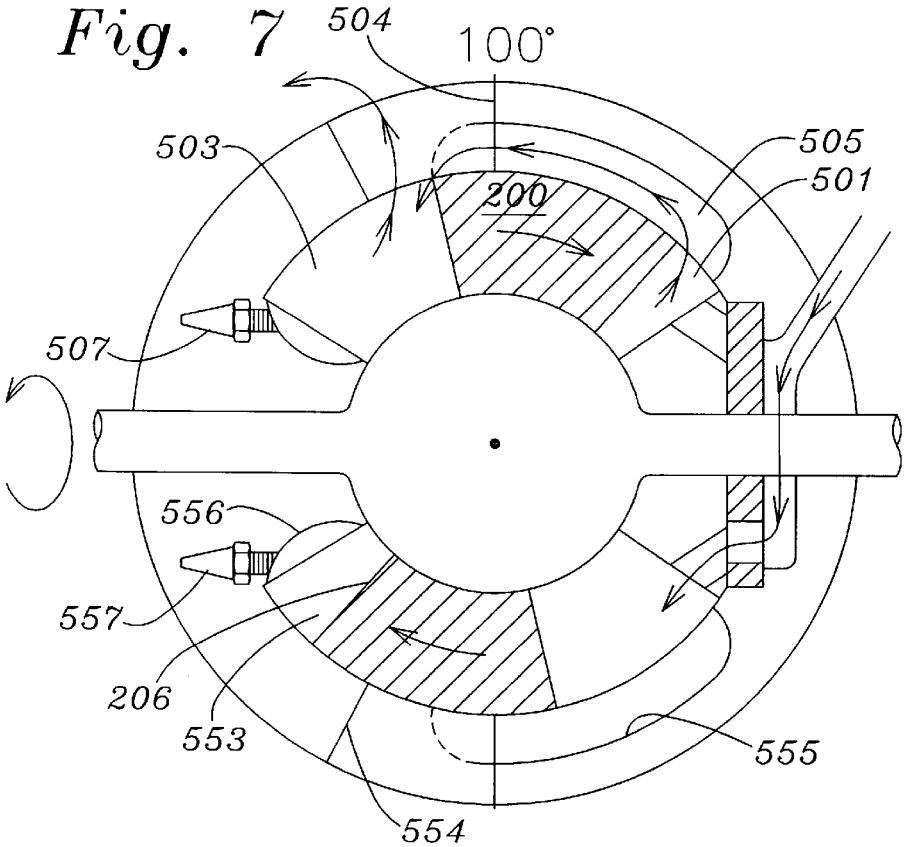

As the displacement member 200 continues to rotate to the approximate 100° position as shown in FIG. 7, the mixture in chamber 501 is further compressed until the displacement member 200 has rotated sufficiently far to uncover (open) the bypass port 505 wherein the compressed mixture is transferred around the displacement member 200 into the combustion chamber 503. Likewise, the mixture in combustion chamber 553 is further compressed inasmuch as exhaust port 554 is fully closed. At this time, the rotary valve 550 is also open to permit the mixture to enter intake chamber 551 and closed to prevent communication with intake chamber 501.

Figure 8:
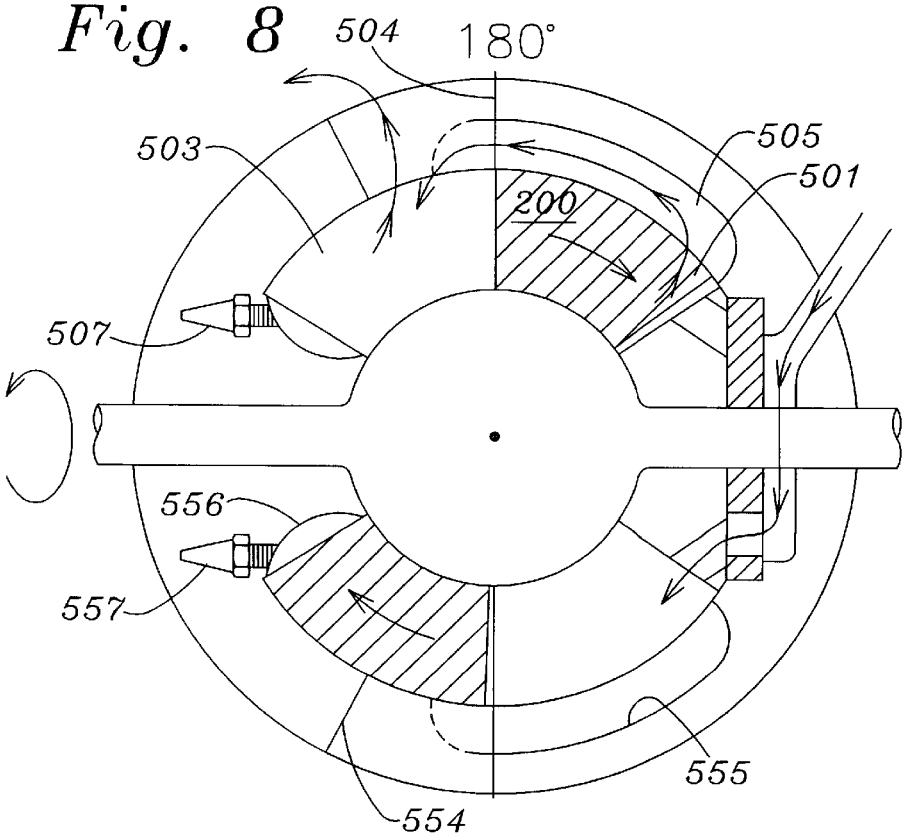

When the displacement member 200 reaches the 180° position as shown in FIG. 8, the rotary valve 550 is about to close to prevent input of the mixture to either intake chamber 501 or 551. The bypass port 505 is opened and exhaust port 504 is closed so that partially compressed mixture is passed from intake chamber 501 to compression chamber 503. Concurrently, both exhaust port 554 and bypass port 555 are closed and the mixture in compression chamber 553 is, effectively, compressed into the ignition chamber 556. At this time, the igniter 557, typically a spark plug, fires and causes the combustion of the mixture which applies a force against the surface 206 of the lower portion of the displacement member 200 to thereby drive the displacement member 200 in the counter clockwise direction as shown in FIG. 9.

Figure 9:
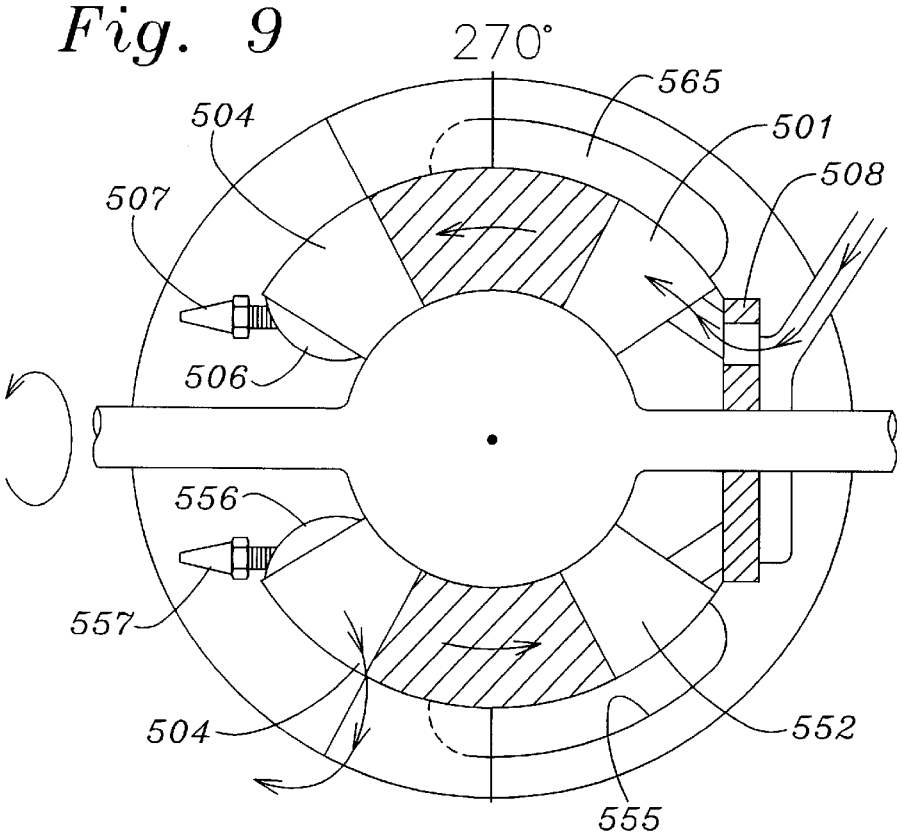

When the displacement member 200 reaches the 270° position of FIG. 9, the operation of the engine is, essentially, the opposite of the operation at the 90° position. That is, the displacement member 200 is partially compressing the mixture in intake chamber 551 and forcing it through bypass port 555 while exhausting spent materials through exhaust port 554. Conversely, mixture is being supplied to intake chamber 501 via input port 502 (while each of the bypass ports 505 and exhaust ports 504 are closed). Concurrently, the mixture previously transferred to compression chamber 503 is being compressed for operation as described supra.

Figure 10:
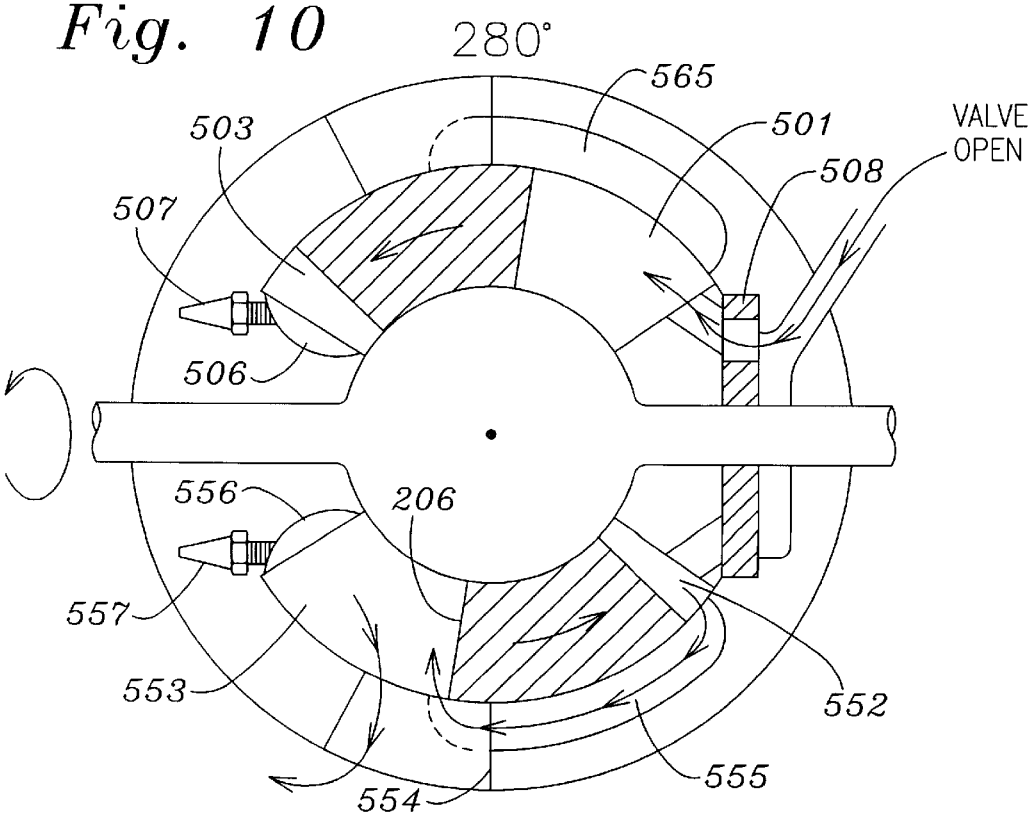

At the approximately 280° position, as seen in FIG. 10, exhaust port 554 is fully open and the spent materials exhausted therethrough, while bypass port 555 begins to open and the mixture begins to bypass around the displacement member 200 into compression chamber 553 (as pushed by the displacement member) inasmuch as the rotary valve 550 to intake chamber 551 is closed. Conversely, the rotary valve 550 is open to permit mixture to flow into intake chamber 501. However, bypass port 505 and exhaust port 504 are closed by the displacement member 200 which compressed the mixture in compression chamber 503 in preparation for firing of the igniter 507 similar to the operation as described supra, relative to compression chamber 503.

Thus, it is seen that the displacement member 200 is mounted in the housing 404 by the bearings 403 and 416 which permit only rotational movement around the X-axis as shown in FIG. 1. The displacement member 200 does not have lateral movement in any direction especially along the Y or Z-axes. The rotational movement of displacement member is, of course, limited to an arc movement.

Likewise, the drive shaft assembly 350 is rotatably mounted in the housing 404 and within the displacement member 200 which permits motion only around the Z-axis as shown in FIG. 1. That is, the drive shaft 401 is essentially formed with the nutating member 310 which is constrained by the interaction of the pintles 315 and 316 with the displacement member 200 as described above. As a result, the intersection point CP (see FIG. 1) of the drive shaft 401 and the bearings 403 and 416 does not move relative to the housing 104.

Because of the angular relationship between the notating member 310 (as part of the drive shaft assembly 350), the drive shaft 401 of the engine rotates in a prescribed direction, i.e. clockwise or counter clockwise, but the center point CP of the displacement member 200 does not move relative to the engine housing 404. This is a distinct advantage with regard to, inter alia, the lubrication of the engine.

Thus, there is shown and described a unique design and concept of a rotary displacement device. While this description is directed to a particular embodiment it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. An internal combustion engine comprising:

a housing, said housing includes a spherical cavity therein, a generally spherical displacement member rotatably mounted in said spherical cavity in said housing by axial bearings, shaft means rotaoably mounted in said housing and engaged with said displacement member to be selectively driven thereby, a nutating member rotatably mounted on said shaft means and engaged with said spherical displacement member so as to impart motion thereto.

2. An engine housing comprising, a housing enclosing a spherical cavity therein, a displacement member with at least one spherical surface mounted within said spherical cavity in said housing, a notating member with at least one spherical surface, said nutating member engaged with and operative to selectively move said displacement member, and a drive shaft with at least one spherical surface, said drive shaft engaged with said nutating member and selectively movable therewith.

3. The engine recited in claim 2 in which, said spherical surface of said nutating member and said spherical surface of said drive shaft cooperate to form a common spherical surface.

4. The engine recited in claim 2 in which, said displacement member and said nutating member are in a relative driving relationship about an axis common to the nutating member.

5. The engine recited in claim 2 in which, each of said displacement member, said nutating member, and said drive shaft has an axis of movement all of which converge at a common point.

6. The engine recited in claim 2 in which, said spherical surfaces of said displacement member, said nutating member, and said drive shaft each includes segmented portions thereof and, said housing includes an inner surface with segmented portions thereof, wherein said segmented portions of said inner surface of said housing and the segment portions of said spherical surfaces of said displacement member, said nutating member and said drive shaft cooperate to form variable displacement chambers in association with the movement of the displacement member.

7. The engine recited in claim 2 in which, said spherical surfaces of said displacement member, said nutating member, and said drive shaft are the outer surfaces respectively;

each of said outer surfaces includes segmented portions thereof and, said housing includes a spherical inner surface with segmented portions thereof, wherein said segmented portions of said spherical inner surface of said housing and the segment portions of said outer spherical surfaces of said displacement member, said nutating member and said drive shaft cooperate to form variable displacement chambers in association with the movement of the displacement member.

8. The engine recited in claim 2 wherein, said housing includes a spherical outer surface.

9. The engine recited in claim 5 wherein, said common point is substantially motionless relative to said housing.

10. A rotary displacement device comprising, a housing which includes a spherical cavity therein, a displacement member with a generally spherical configuration mounted within said spherical cavity in said housing, said displacement member including a generally spherical cavity therein, a drive mechanism comprising a drive shaft and a nutating member mounted thereto, said drive shaft and said notating member configured to define a generally spherically shaped mounting portion of said drive mechanism, said drive mechanism mounted in engagement with said displacement member within said spherical cavity in said housing, wherein said displacement member is operative to travel in an arc within said spherical cavity in said housing and to engage and move said nutating member which causes said drive shaft to rotate around its axis.

11. The device recited in claim 10 wherein, said displacement member comprises a hollow sphere with drive shaft apertures on opposite faces thereof for passage of the ends of said drive shaft therethrough.

12. The device recited in claim 11 wherein, said drive shaft apertures define force surfaces at said hollow sphere and at the perimeters of said apertures.

13. The device recited in claim 10 wherein, said nutating member comprises a generally annular body with a central bore therethrough, and a pair of pintles extending radially outward from said annular body.

14. The device recited in claim 13 wherein, said driveshaft comprises first and second shaft portions which engage each other at one end thereof, said one end of said first shaft portion including a bore therein, said one end of said second shaft portion including a bearing shaft extending therefrom and adapted to snugly engage said bore in said one end of said first shaft member.

15. The device recited in claim 14 wherein, said bearing shaft is adapted to pass through said central bore in said annular body of said nutating member and to engage said bore in said one end of said first shaft portion.

16. The device recited in claim 14 wherein, said one end of each of said second shaft portions has a generally hemispherical configuration.

17. The device recited in claim 13 wherein, said pintles on said nutating member engage bores in said displacement member.

18. The device recited in claim 7 wherein, said segmented section of said outer surfaces cooperate with said segmented sections of said inner surface to form variable volume chambers wherein an air/fuel mixture which is provided thereto is selectively compressed, combusted and exhausted therefrom.

19. The device recited in claim 12 wherein, said force surfaces form a portion of a combustion chamber of said engine whereby force is selectively applied against said force surfaces to travel in the arc and rotate said drive shaft.

20. The engine recited in claim 18 including, a rotary valve for controlling the provision of said air/fuel mixture to said segmenting sections.

* * * * *